US006866533B2

(12) United States Patent
Wu

(10) Patent No.: US 6,866,533 B2
(45) **Date of Patent: *Mar. 15, 2005**

(54) CABLE CONNECTOR ASSEMBLY HAVING PULL TAB

(75) Inventor: Jerry Wu, Irvine, CA (US)

(73) Assignee: Hon Hai Precision Ind. Co., Ltd., Tu-Chen Taipei Hsien (TW)

( * ) Notice: Subject to any disclaimer, the term of this patent is extended or adjusted under 35 U.S.C. 154(b) by 10 days.

This patent is subject to a terminal disclaimer.

(21) Appl. No.: 10/421,340

(22) Filed: Apr. 22, 2003

(65) Prior Publication Data

US 2004/0214469 A1 Oct. 28, 2004

(51) Int. Cl.[7] ..... H01R 13/627
(52) U.S. Cl. ..... 439/352; 439/358; 439/484
(58) Field of Search ..... 439/483, 484, 439/152, 153, 357, 358, 906, 362, 352

(56) References Cited

U.S. PATENT DOCUMENTS 5,564,939 A 10/1996 Maitani et al.
5,788,534 A 8/1998 Koegel et al.
5,820,412 A 10/1998 Koegel et al.
6,217,365 B1 * 4/2001 Shinozaki ..... 439/358
6,589,066 B1 * 7/2003 Wu ..... 439/352
6,592,391 B1 * 7/2003 Wu ..... 439/352
6,648,665 B1 * 11/2003 Wu ..... 439/352
6,648,666 B1 * 11/2003 Wu ..... 439/352
6,659,790 B1 * 12/2003 Wu ..... 439/352

* cited by examiner

*Primary Examiner*—Renee Luebke

(57) ABSTRACT

A cable connector assembly (1) includes a first and a second cover-halves (3, 4) joined together to define a front and a second end, an insulative housing (20) retained in the front end of the first and the second cover-halves, a number of contacts (22) retained in the insulative housing, a cable (7) electrically connected with the contacts, a fastening member (5) and a pull tab (8). A first passage (45) extends through the front and the rear ends. The fastening member is movably and rotatably received in the first passage and includes a medial portion (50), a threaded portion (52) extending from the medial portion, and an operating portion (54) extending from the medial portion opposite to the threaded portion. The pull tab is movably mounted to the rear end of the cover-halves and is secured to the fastening member for separating the cable connector assembly from the complementary connector.

21 Claims, 12 Drawing Sheets

3

3

CABLE CONNECTOR ASSEMBLY HAVING PULL TAB

CROSS-REFERENCES TO RELATED APPLICATION

Relevant subject matter is disclosed in U.S. Pat. No. 6,589,066 filed on Jul. 30, 2002 and entitled "ELECTRICAL CONNECTOR HAVING A LATCH MECHANISM", U.S. patent application Ser. No. 10/210,129 filed on Jul. 31, 2002 and entitled "ELECTRICAL CONNECTOR HAVING A LATCH MECHANISM", U.S. Pat. No. 6,702,602 filed on Sep. 4, 2002 and entitled "ELECTRICAL CONNECTOR HAVING IMPROVED LATCH MECHANISM", U.S. Pat. No. 6,702,603 filed on Sep. 5, 2002 and entitled "ELECTRICAL CONNECTOR HAVING ENGAGING DEVICE", U.S. patent application Ser. No. 10/305,716 filed on Nov. 27, 2002 and entitled "ELECTRICAL CABLE CONNECTOR ASSEMBLY" and U.S. Ser. No. 10/387,902 filed on Mar. 12, 2003 and entitled "CABLE END CONNECTOR HAVING LOCKING MECHANISM", all of which are invented by the same inventor as this patent application and assigned to the same assignee with this application.

BACKGROUND OF THE INVENTION

1. Field of the Invention

The present invention generally relates to a cable connector assembly, and more particularly to a cable connector assembly having an additional pull tab for separating the cable connector assembly from a complementary connector more conveniently.

2. Description of Related Art

It is well known that a cable connector assembly comprises a cable end connector and a cable terminating to the cable end connector. The cable connector assembly electrically connects with a complementary connector to transmit signals from the cable to the complementary connector. The cable connector assembly and the complementary connector are often equipped with interlocking mechanisms to secure two mated connectors together.

U.S. Pat. Nos. 5,788,534 and 5,820,412 both issued to Koegel et al., each disclose a cable connector assembly having a pair of jackscrews assembled thereto. The jackscrew has an operating portion for being operated by a screw driver or by some other tools or by an operator's fingers, a threaded portion for engaging with a mating connector and a medial portion interconnecting the operating portion with the threaded portion. The cable connector assembly comprises a contact module terminating an electrical cable and an upper and a lower covers enclosing the contact module. The lower cover defines a pair of first channels at two opposite lateral sides thereof. The upper cover defines a pair of second channels aligned with first channels. The pair of jackscrews is received in the first and the second channels in a manner that allows the rotation and movement of the jackscrews. When the cable connector assembly mates with the mating connector, the operating portion is operated to rotatably and movably actuate the threaded section to engage with a locking nut of the mating connector.

When the cable connector assembly is to be separated from the mating connector, the operator needs to loosen the screw-nut connection between the connectors by using the screw driver or the fingers of the operator. However, a panel of a chassis to which the mating connector is mounted may have so many components mounted thereon that the operator can only loosen the screw connection by using the screw driver. Then the operator has no choice but pull the electrical cable exposed out of the cable connector assembly for separating the cable connector assembly completely from the mating connector. The electrical cable usually comprises a plurality of wires each comprising at least one conductor. The conductors are respectively soldered with the contact module for establishing an electrical connection with the contact module to transmit signals. Under such condition, to completely separate the mated connectors, the pulling force must be bigger than a mating force therebetween. When such pulling force is exerted on the cable, the conductors stand a good chance of being divorced from the contact module. Thus, the signal transmission is adversely influenced.

U.S. Pat. No. 5,564,939, issued to Maitani et al., on Oct. 15, 1996, discloses a kind of latch spring used for a conventional cable connector assembly. The cable connector assembly comprises a pair of latch springs respectively attached on opposite sides of a housing of the assembly. An operating member has a pair of latch releasing cams located below angled portions of the latch springs. When an operator pulls a pull tab of the operating member backwardly, the latch releasing cams exert outward forces on the angled portions and U-shaped claws slip out to release a mated complementary connector. However, the structure of the latch springs is relatively complex, thus, the manufacturing cost thereof is relatively high. In addition, because the latch springs are positioned outside of the housing, they are easy to be damaged by a force exerted thereon.

Hence, a cable connector assembly with an improved pull tab for achieving a reliable transmission is needed to address the problems encountered in the related art.

SUMMARY OF THE INVENTION

An object of the present invention is to provide a cable connector assembly conveniently separating from a complementary connector.

Another object of the present invention is to provide a cable connector assembly having a simply structured pull tab.

In order to achieve the objects set forth, a cable connector assembly in accordance with the present invention comprises a cover, an insulative housing, a plurality of contacts retained in the insulative housing, a cable electrically connected with the contacts, a fastening member, and a pull tab. The cover comprises a first and a second cover-halves joined together. The cover defines a front end and a rear end opposite to the front end. The insulative housing is situated at the front end of the cover. A first passage extends through the front and the rear ends of the cover. The fastening member is movably and rotatably received in the first passage and comprises a medial portion, a threaded portion extending from the medial portion adapted for threadedly engaging with a complementary connector, and an operating portion extending from the medial portion opposite to the threaded portion. The medial portion comprises a stop section. The pull tab is movably assembled to the rear end of the cover and secured to the fastening member for separating the cable connector assembly from the complementary connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
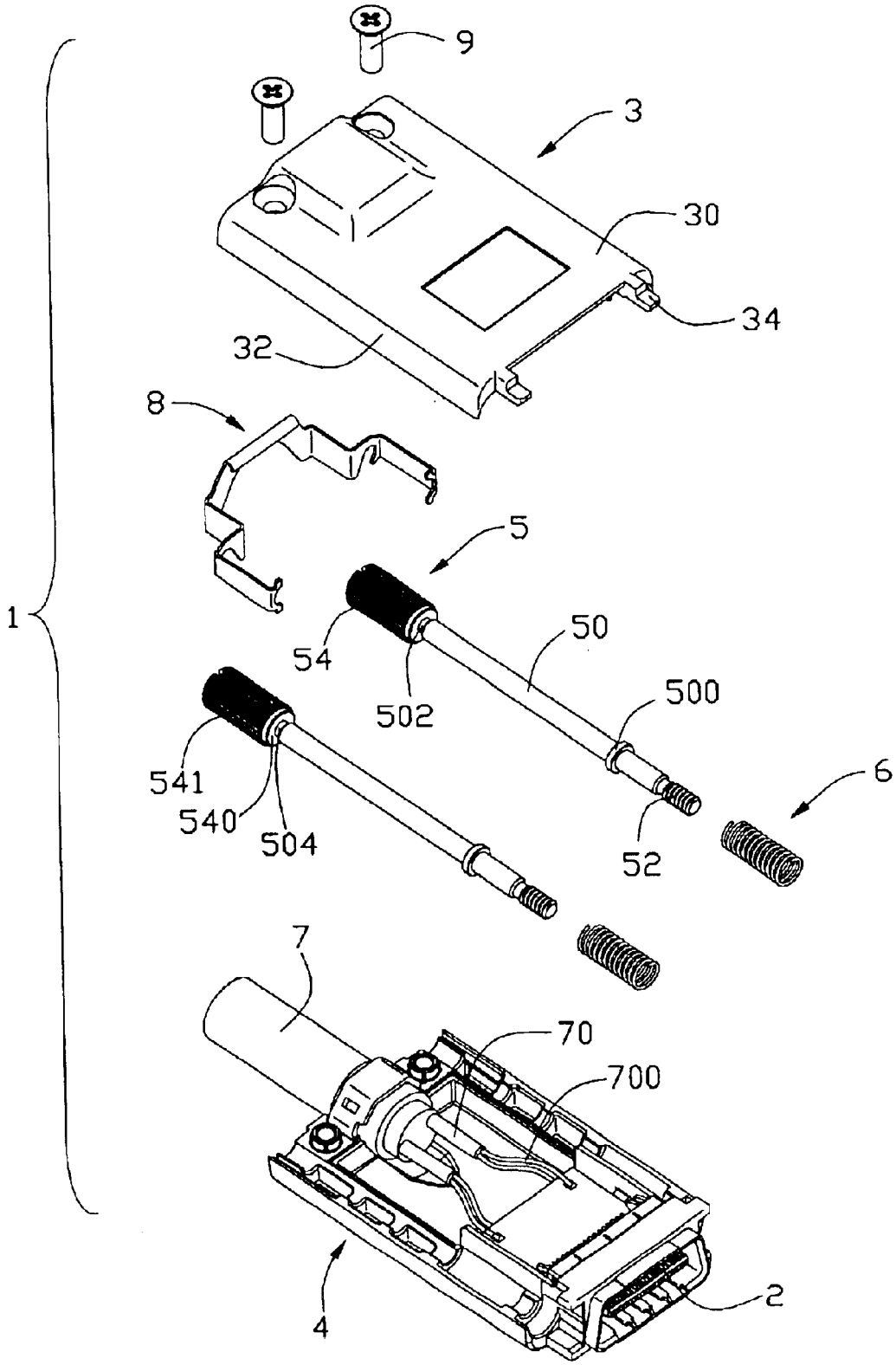
FIG. 1 is a partially exploded, perspective view of a cable connector assembly in accordance with the present invention.

Referring to FIG. 1, a cable connector assembly 1 in accordance with the present invention comprises a contact module 2, an upper die cast cover-half 3, a lower die cast cover-half 4, a pair of fastening members 5, a pair of spring members 6, an electrical cable 7, a pull tab 8 and a pair of screws 9.

Figure 2:
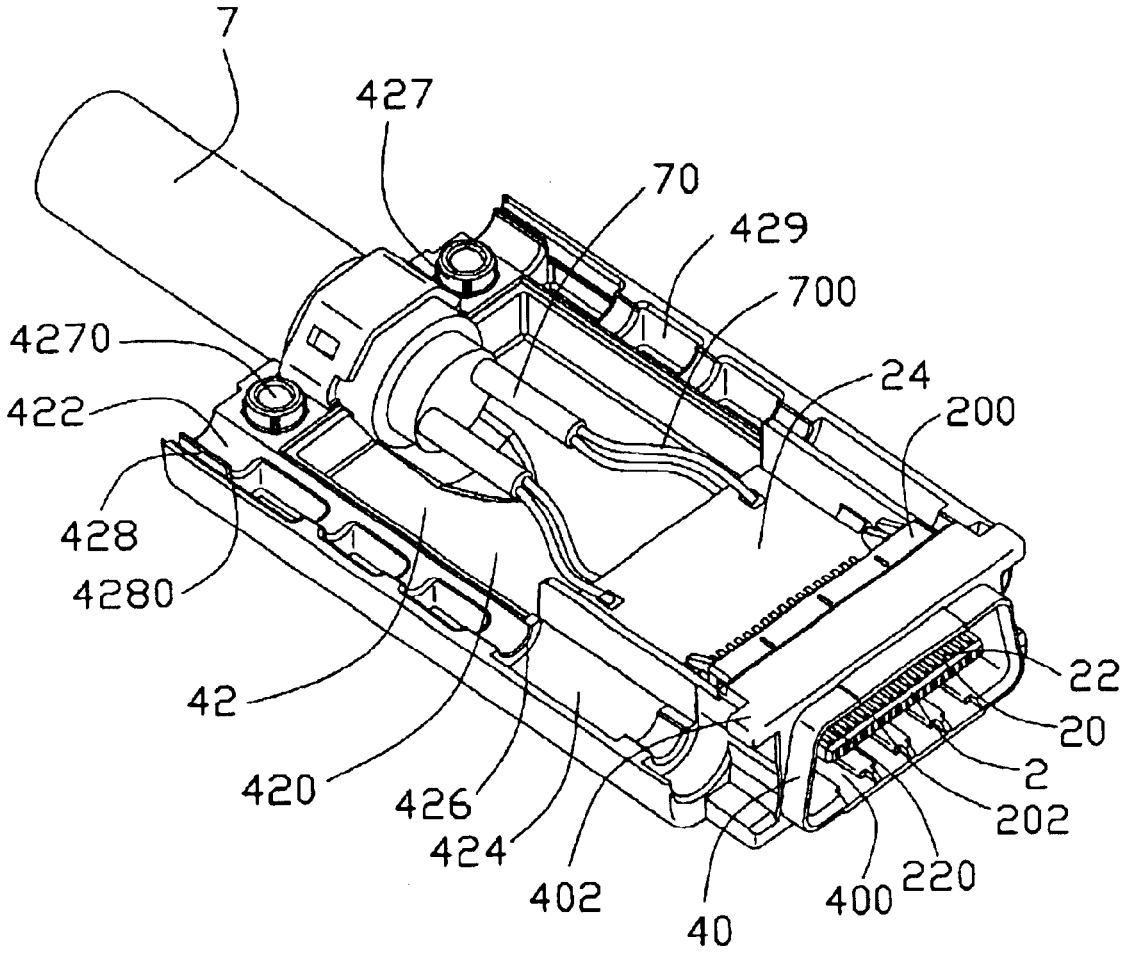
FIG. 2 is a perspective assembled view of a lower cover-half, a cable and a contact module of FIG. 1.
Figure 3:
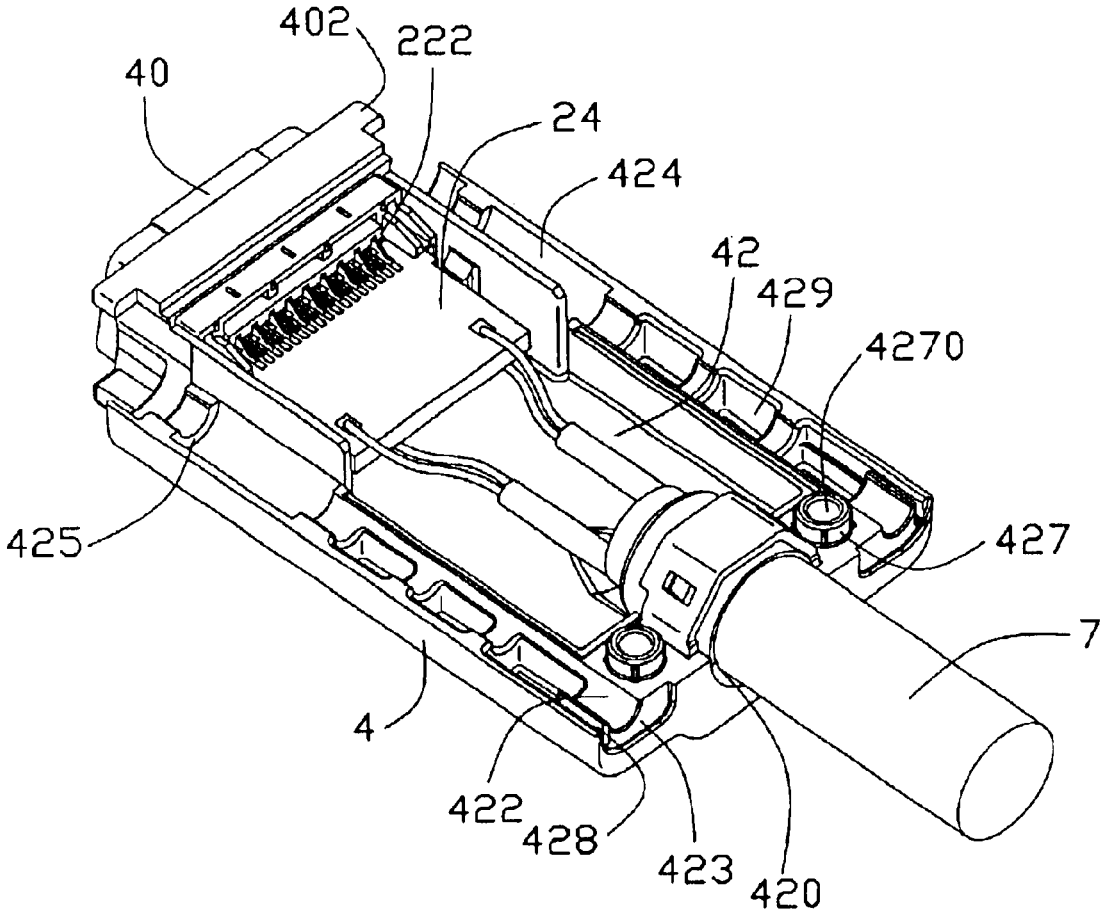
FIG. 3 is a view similar to FIG. 2, but taken from a rear aspect.

Referring to FIGS. 1-3, the contact module 2 comprises an insulative housing 20, a plurality of contacts 22 and a printed circuit board 24. The insulative housing 20 comprises a base portion 200, a tongue portion 202 extending forwardly from the base portion 200 and a plurality of passageways (not labeled) extending from the tongue portion 202 through the base portion 200.

The contacts 22 are received in the passageways of the insulative housing 20. Each contact 22 comprises a contacting portion 220 retained in the tongue portion 202 for contacting with a complementary connector (not shown) and a connecting portion 222 extending in a direction opposite to the contacting portion 220 beyond a rear face of the base portion 200.

The printed circuit board 24 is assembled to the base portion 200 of the insulative housing 20 and is straddled by and electrically connected with the connecting portions 222 of the contacts 22 at a front end thereof.

Figure 4:
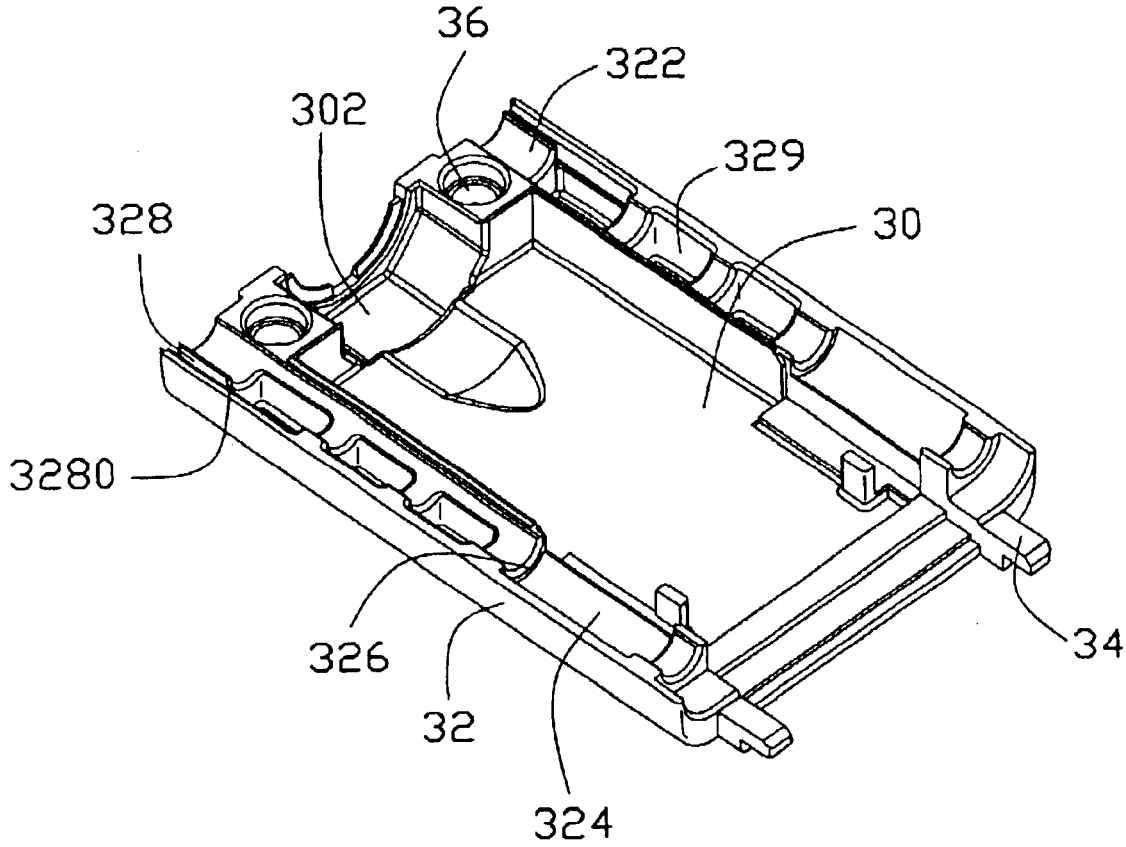
FIG. 4 is a perspective view of an upper cover-half shown in FIG. 1, but taken from a bottom view.
Figure 5:
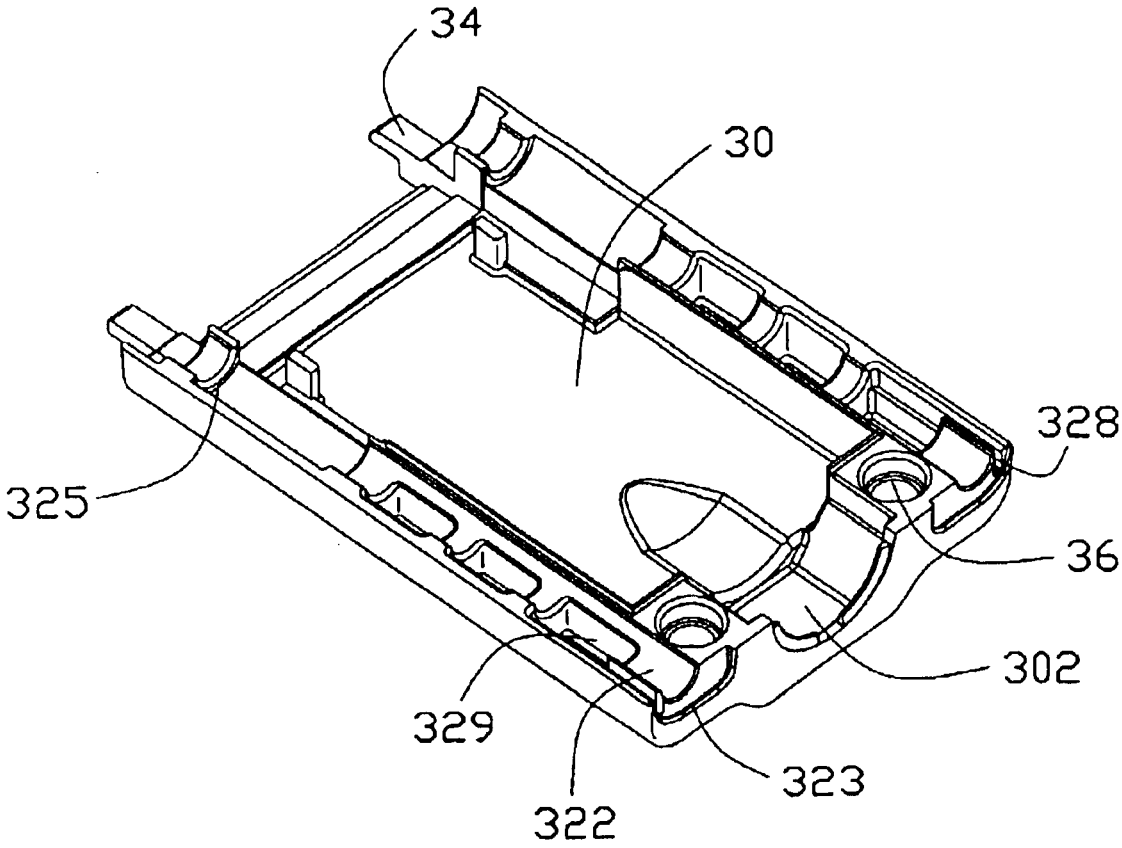
FIG. 5 is a view similar to FIG. 4, but taken from a rear aspect.

Referring to FIG. 4 and FIG. 5, the upper cover-half 3 comprises a generally planar body portion 30, a pair of flanges 32 extending downwardly from opposite lateral sides of the body portion 30 and a pair of spaced fingers 34 extending forwardly from a front end of the body portion 30. The body portion 30 defines a first substantially semicircular opening 302 at a rear end thereof. Each flange 32 defines a first channel 322 extending through a whole length thereof and a first depression 323 (see FIG. 5) at the rear end thereof in communication with the first channel 322. A first slit 328 is defined in the rear end of each flange 32 and is in parallel with the first channel 322. The first slit 328 communicates with the first depression 323 and communicates with the first channel 322 at a first edge 3280 thereof. The first channel 322 comprises a first recessed section 324 adjacent to a front portion thereof. The first recessed section 324 recesses more deeply and widely than other portions of the first channel 322 and defines a front end 325 and an opposite rear end 326 respectively connecting with front and rear portions of the first channel 322. A pair of first screw holes 36 is defined in the rear end of the upper cover-half 3 and spaced by the first semicircular opening 302. The flanges 32 define a plurality of cutouts 329 therein to reduce the weight of the upper cover-half 3.

Referring to FIG. 2 and FIG. 3, the lower cover-half 4 comprises a mating frame 40 defining a cavity 400 therein and a cover body 42 extending rearwardly from the mating frame 40. The mating frame 40 has a pair of engaging ears 402 extending laterally outwardly from a top portion thereof. The cover body 42 defines a space 420 in communication with the cavity 400, a pair of second channels 422 at opposites lateral sides thereof and a pair of second depressions 423 at a rear end thereof respectively in communication with the second channels 422. A second slit 428 is defined in the rear end of each lateral side of the cover body 42 and is in parallel with the second channel 422. The second slit 428 communicates with the second depression 423 and communicates with the second channel 422 at a second edge 4280 thereof. The second channels 422 extend through a whole length of the cover body 42. Each second channel 422 comprises a second recessed section 424 corresponding to the first recessed section 324 of the first channel 322. The second recessed section 424 recesses more deeply and widely than other portions of the second channel 322 and defines a front end 425 and an opposite rear end 426 respectively connecting with front and rear portions of the second channel 422. A pair of posts 427 protrudes upwardly adjacent to the rear end of the cover body 42 with a second screw hole 4270 defines therein. The cover body 42 also defines a plurality of cutouts 429 to reduce the weight of the lower cover-half 4 and a second substantially semicircular opening 420 at the rear end thereof.

Referring to FIG. 1, each of the fastening member 5 is generally cylindrical and is sometimes called jackscrew by some people. The fastening member 5 comprises an elongated medial portion 50, a threaded portion 52 extending forwardly form the medial portion 50 and an operating portion 54 extending rearwardly from the medial portion 50. The medial portion 50 is formed with an annular stop section 500 protruding outwardly from a circumferential periphery thereof. The operating portion 54 has a contacting section 540 (FIG. 1) adjacent to the medial portion 50. A recess 502 is defined inwardly from the circumferential periphery of the medial portion 50 to form a thinner portion 504 adjacent the contact section 540 of the operating portion 54. An outer surface 541 of the operating portion 54 is slotted for increasing a friction between fingers of a user and the operating portion 54 when the user grabs the operating portion 54.

Figure 6:
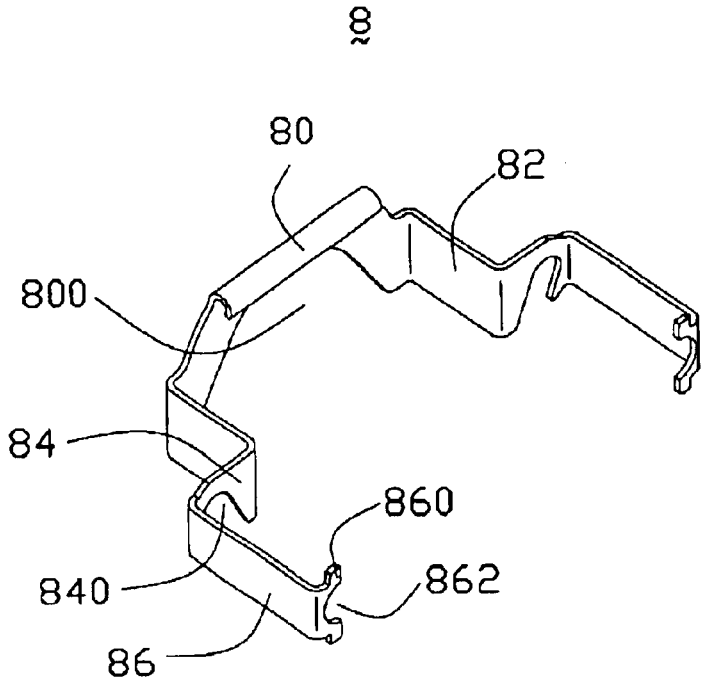
FIG. 6 is a perspective view of a pull tab shown in FIG. 1.
Figure 7:
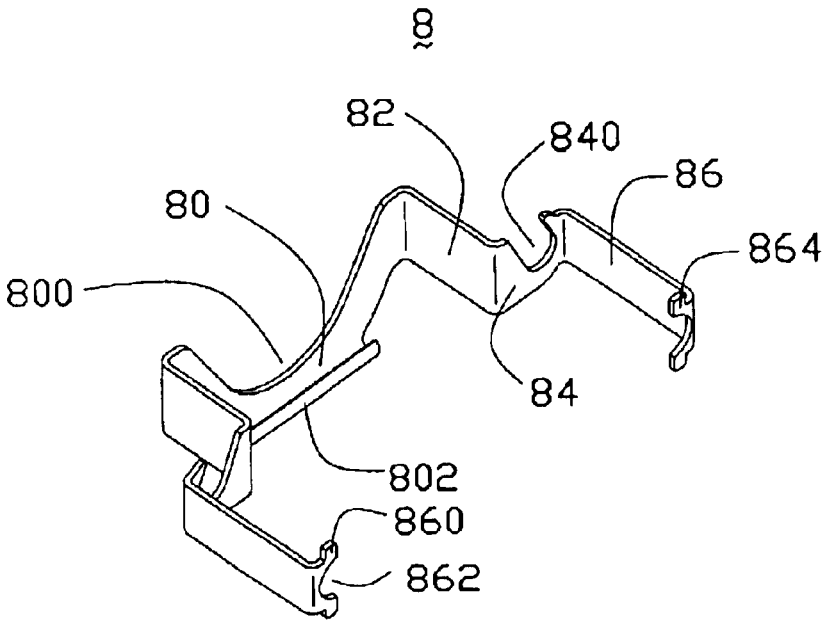
FIG. 7 is a view similar to FIG. 6, but taken from a bottom aspect.

Referring to FIGS. 6-7, the pull tab 8 comprises a pair of spaced first arms 86, a pair of opposite medial sections 84 respectively extending laterally inwardly from opposite rear ends of the first arms 86, a pair of second arms 82 respectively extending rearwardly from opposite inner edges of the medial sections 82 and in parallel to the first arms 86, and a pulling section 80 connecting the second arms 82 and extending laterally inwardly and upwardly from opposite rear ends of the second arms 82. The pulling section 80 is so configured to form a semicircular space 800 in a lower section thereof. The pulling section 80 also forms a grasp section 802 on the top thereof. Each medial section 84 defines an engaging recess 840 extending upwardly and outwardly from a lower edge thereof. Each first arm 86 forms a claw 860 extending inwardly from a front end thereof The claw 860 defines a semicircular hole 862 extending outwardly from an inner edge thereof and a pair of securing sections 864 formed on a pair of upper and lower edges thereof.

The cable 7 comprises a plurality of wires 70 therein. Each wire 70 has at least one conductor 700 electrically connecting with a rear end of the printed circuit board 24.

Figure 8:
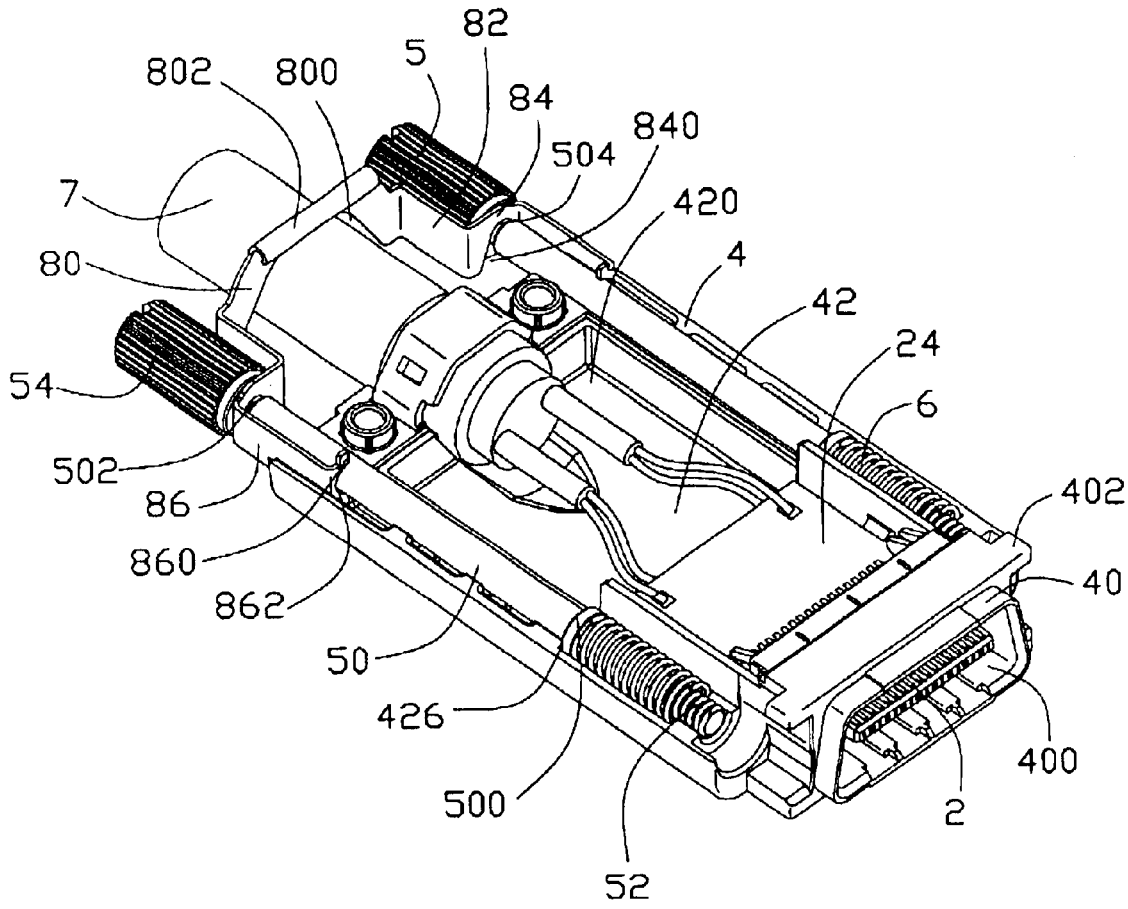
FIG. 8 is a partially perspective assembled view of FIG. 1, without the upper cover-half to show a pair of jackscrews thereof in a loosen position.
Figure 9:
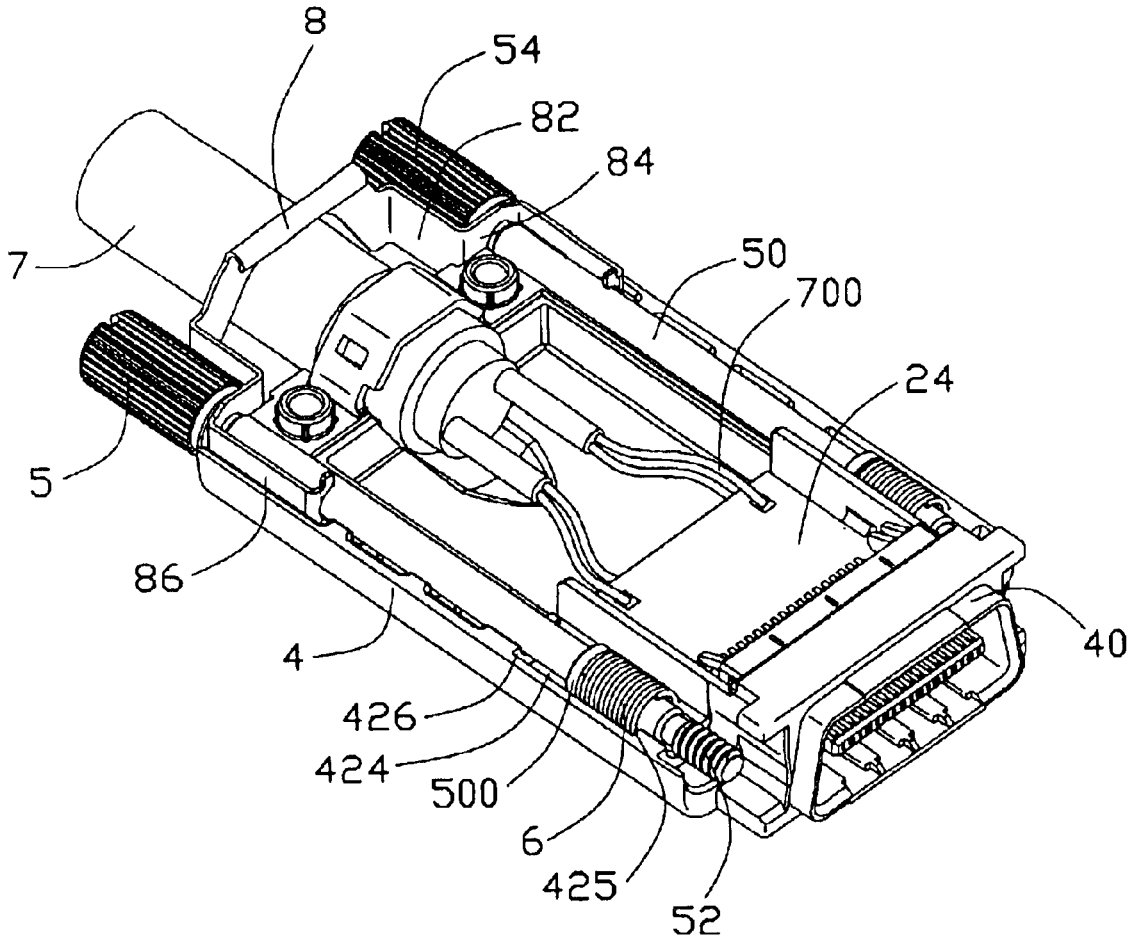
FIG. 9 is a view similar to FIG. 8, but showing the pair of jackscrews in a fixed position.

Referring to FIG. 8 and FIG. 9, in assembly, the contact module 2 is assembled in the lower cover-half 4 with the tongue portion 202 having the contacting portions 220 thereon being accommodated in the cavity 400 of the mating frame 40 and the printed circuit board 24 extending into the space 420. A front end of the cable 7 is received in the second hole 420 with the conductors 700 electrically connecting with the rear end of the printed circuit board 24.

The fastening members 5 are disposed in the second channels 422 of the lower cover-half 4 with the stop sections 500 being located in the second recessed sections 424 adjacent to the second ends 426 (referring to FIG. 1) of the recessed sections 424.

Each of the spring members 6 is disposed on a corresponding fastening member 5. When the fastening member 5 is disposed in the second channel 422, the spring member 6 is received in a corresponding second recessed section 424 with one end abutting against the stop section 500 of the fastening member 5 and the other end abutting against the front end 425 of the second recessed section 424.

The pull tab 8 is disposed on the pair of fastening members 5. When the fastening member 5 is disposed in the second channel 422, the pulling section 80 and the pair of second arms 82 of the pull tab 8 are positioned between the pair of operating portions 54, and the pair of first arms 86 are respectively movably received in the second slits 428 of the lower cover-half 4. The electrical cable 7 is located below the pulling section 80 and is received in the semicircular space 800. Each medial section 84 of the pull tab 8 is received in the recess 502 of fastening member 5 and is positioned between the contacting section 540 of the operating portion 54 and the medial portion 50 with the thinner section 504 being received in a corresponding engaging recess 840. Each claw 860 of the first arm 86 of the pull tab 8 grasp the medial portion 50 of the fastening member 5 with the medial portion 50 being received in the semicircular hole 862 of the claw 860.

Referring to FIGS. 10-14, the upper cover-half 3 is assembled to the lower cover-half 4 with the fingers 34 partially extending below the engaging ears 402 to engage with the engaging ears 402. The posts 427 of the lower cover-half 4 are received in the first screw holes 36 with the screws 9 screwing into the second screw holes 4270 to securely fasten the upper and the lower cover-halves 3, 4 together. The cable 7 is received in the cable exit 43 formed by the first and the second openings 302, 420. The fastening members 5 are movably and rotatably received in first passages 45 formed by the first and the second channels 322, 422. The stop sections 500 and the spring members 6 are movably accommodated in second passages 47 (FIG. 12) formed by the first and the second recessed sections 324, 424. Each first arm 86 of the pull tab 8 is movably received in a slot 48 (FIG. 14) formed by the first slit 328 and the second slit 428. In such a way, the cable connector assembly 1 is assembled together.

Further referring to FIGS. 10-14, in use, when the cable connector assembly 1 is to be locked with the complementary connector, the operating portions 54 of the fastening members 5 are accessed by the user to push the fastening members 5 forwardly. Since the pull tab 8 is secured between the operating portions 54 and the medial portions 50 of the fastening members 5, the pull tab 8 also move forwardly following the movement of the fastening members 5 with the first arms 86 sliding through the slots 48. The stop sections 500 move forwardly from the rear ends 326, 426 of the recessed sections 324, 424 until the medial sections 84 of the pull tab 8 are received in the depressions 323, 423 of the upper and the lower cover-halves 3, 4. Due to the forward movement of the stop sections 500, the spring members 6 are compressed to be snugly located between the stop sections 500 and the front ends 325, 425 of the recessed sections 324, 424. The threaded portions 52 are rotated by rotating the operating portions 54 to thus engage with locking nuts of the complementary connector, whereby a lock is established between the cable connector assembly 1 and the complementary connector.

When the cable connector assembly 1 is to be unlocked from the complementary connector, the user only needs to rotate the operating portions 54 reversely by using the fingers or by a screw driver. The spring member 6 automatically resumes to its original shape to motivate the fastening member 5 to move rearwardly until the stop section 500 abuts against the rear ends 326, 426 of the recessed sections 324, 424 and the securing sections 864 respectively abut against the first and second edges 3280, 4280 (referring to FIG. 2 and FIG. 4). Then the user can pull the grasp sections 802 of the pulling section 80 rearwardly to separate the cable connector assembly 1 completely from the complementary connector. The resuming force of the spring members 6 exerting on the fastening members 5 causes the fastening members 5 completely separate from the locking nuts of the complementary connector. The separating force exerted on the pull tab 8 is merely a mating force between the cable connector assembly 1 and the complementary connector, thereby decreasing the possibility of damaging the pull tab 8.

Figure 10:
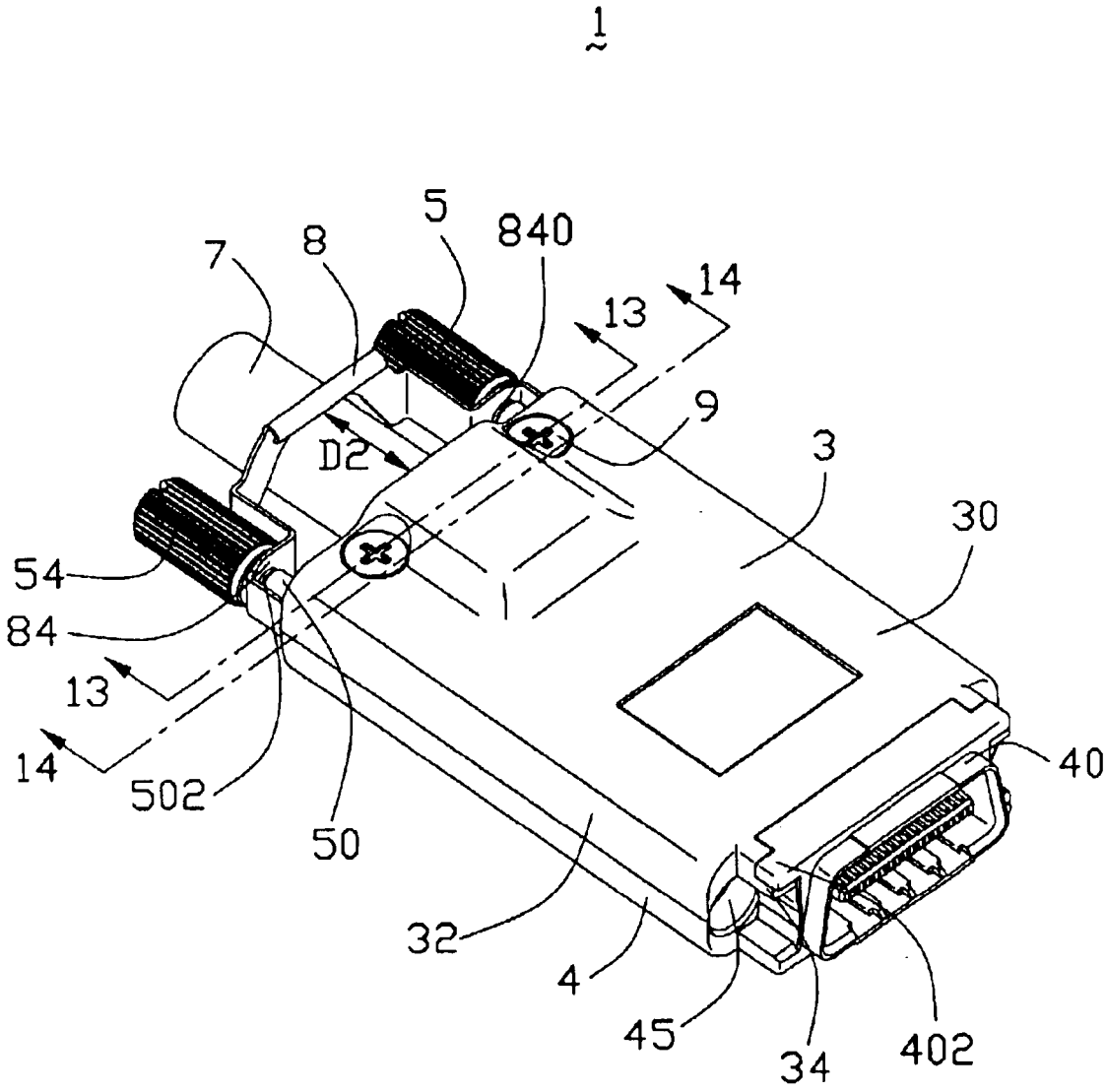
FIG. 10 is a perspective assembled view of FIG. 1 with the pair of jackscrews in the loosen position.
Figure 11:
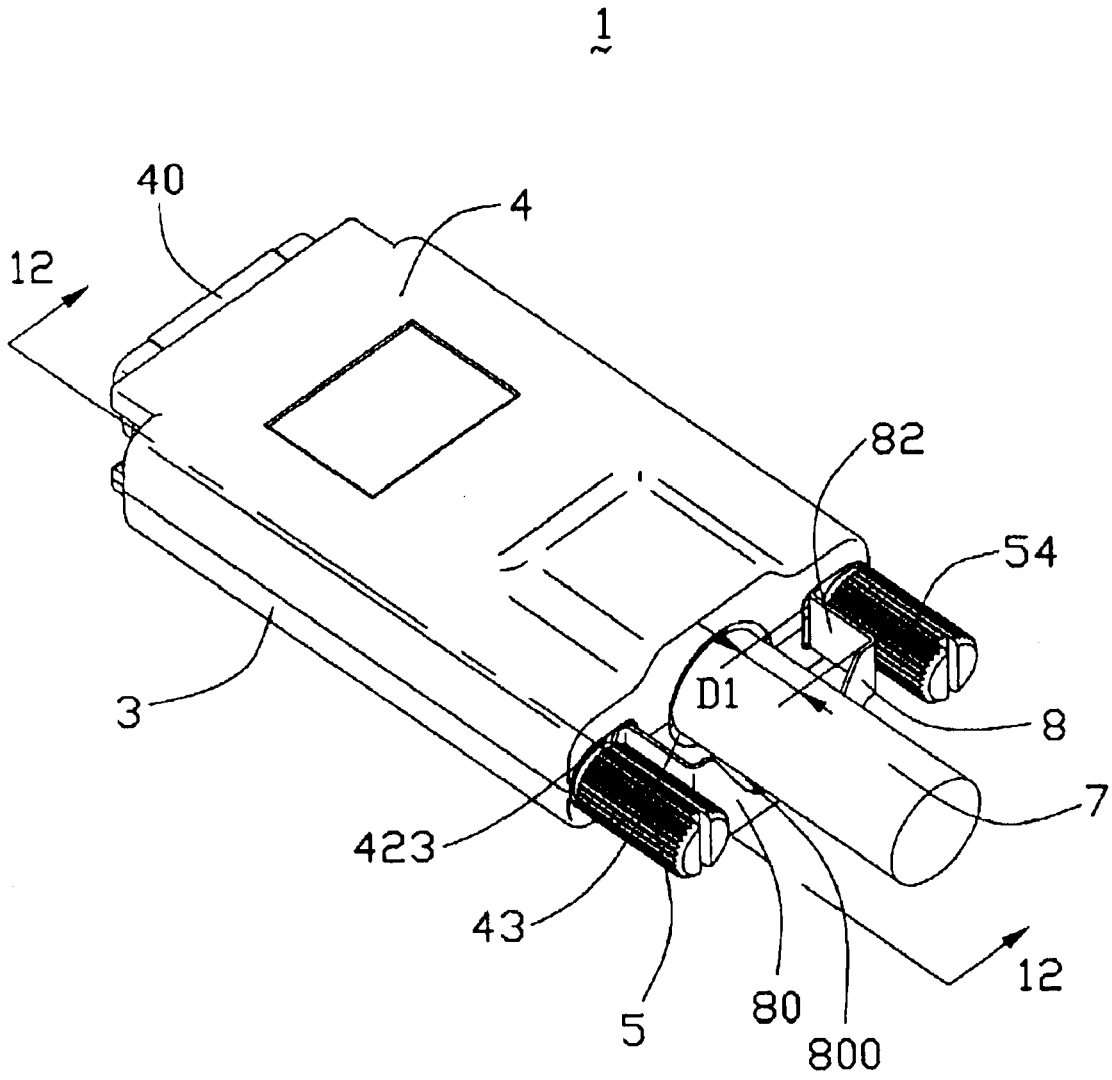
FIG. 11 is a view similar to FIG. 10, but taken from rear and bottom aspects and the pair of jackscrews in the fixed position.
Figure 12:
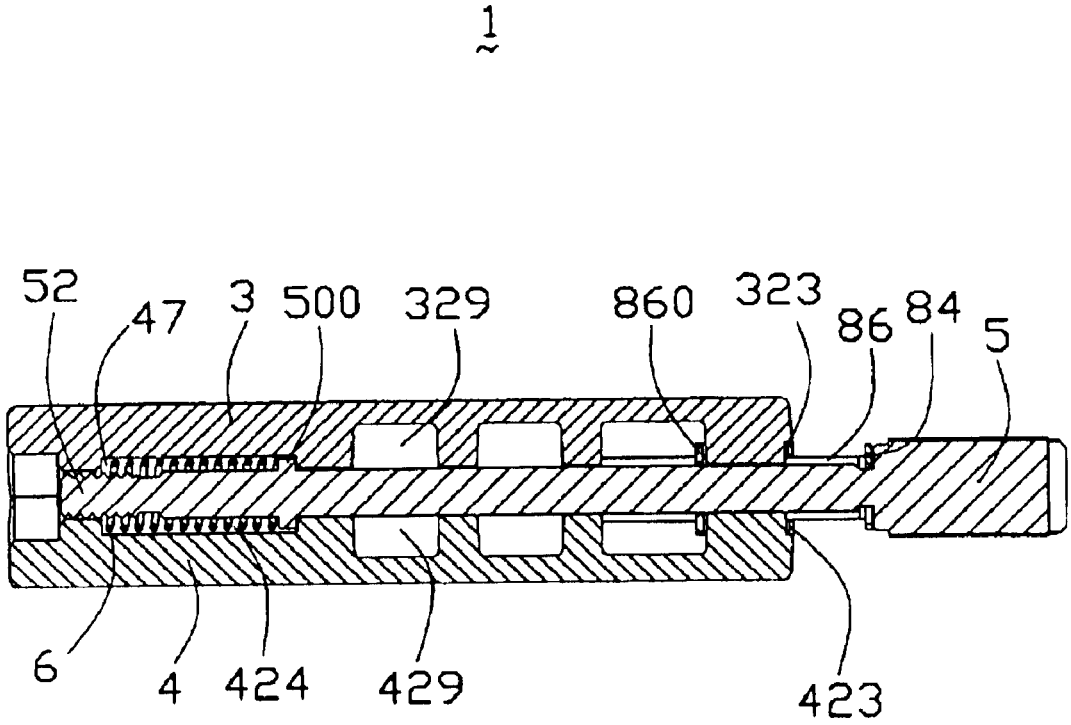
FIG. 12 a cross-sectional view of the cable connector assembly taken along line 12—12 of FIG. 11.
Figure 13:
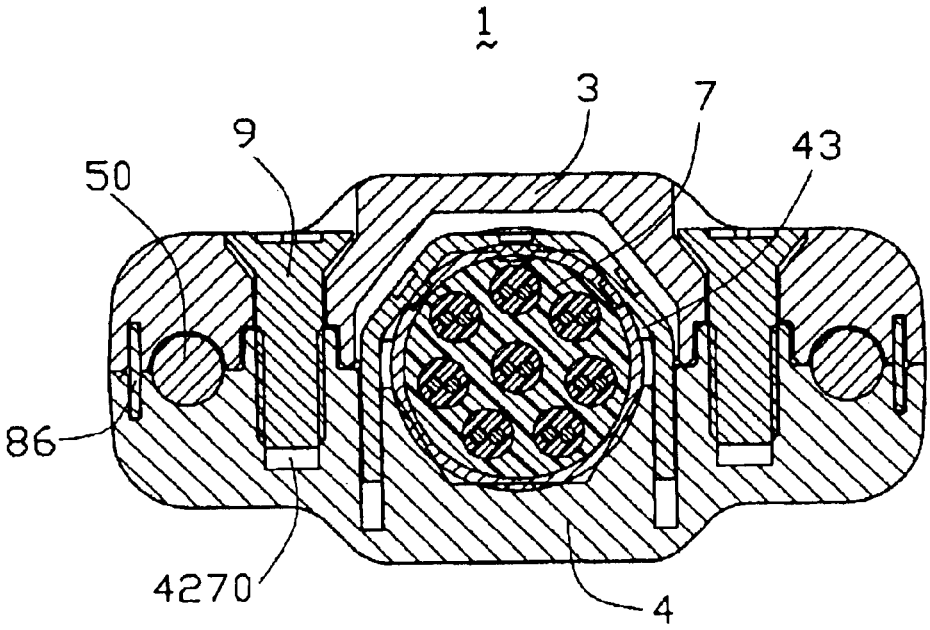
FIG. 13 is a cross-sectional view of the cable connector assembly taken along line 13—13 of FIG. 10.
Figure 14:
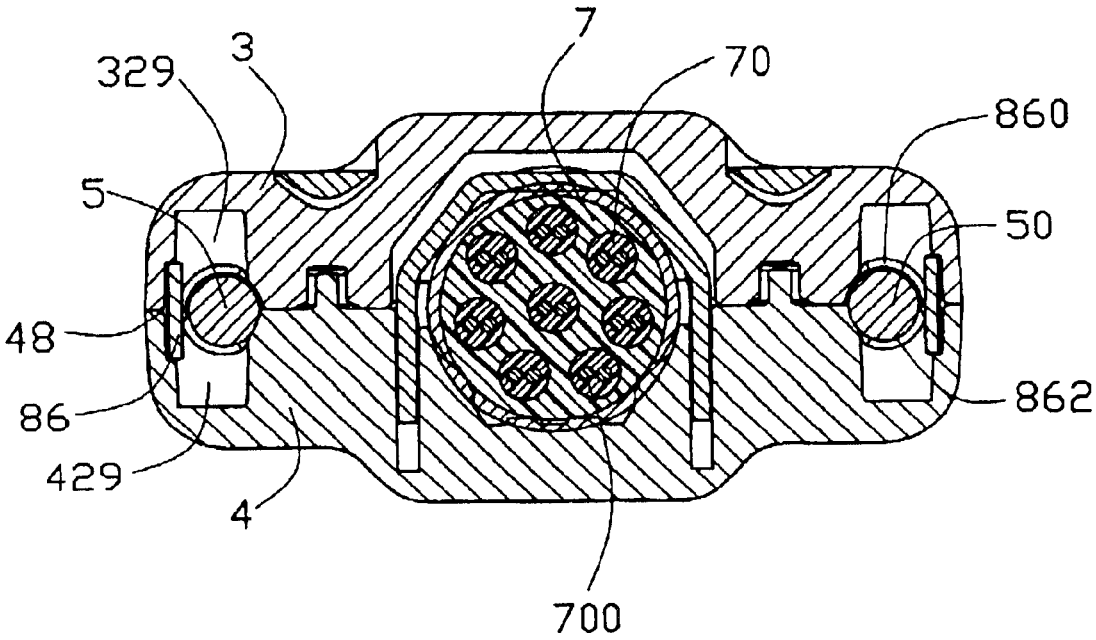
FIG. 14 is a cross-sectional view of the cable connector assembly taken along line 14—14 of FIG. 10.

Referring to FIGS. 10-11, when the cable connector assembly 1 is locked with the complementary connector, a first distance D1 between the grasp section 802 and a rear face of rear portion of the upper cover-half 3 is relatively small for preventing the pull tab 8 from being damaged inadvertently. When the cable connector assembly 1 is unlocked from the complementary connector, a second distance D2 between the grasp section 802 and the rear face of the rear portion of the upper cover-half 3 is relatively large to provide room for the user to pull tab 8 more conveniently.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a cover comprising a first cover-half, a second cover-half joined together with the first cover-half, a front end and a rear end opposite to the front end, a first passage extending through the front and the rear ends;

an insulative housing situated at the front end of the cover;

a plurality of contacts retained in the insulative housing;

a cable electrically connected with the contacts;

a fastening member movably and rotatbly received in the first passage and comprising a medial portion, a threaded portion extending from the medial portion adapted for threadedly engaging with a complementary connector, and an operating portion extending from the medial portion opposite to the threaded portion; and a pull tab movably assembled to the rear end of the cover and secured to the fastening member for separating the cable connector assembly from the complementary connector.

2. The cable connector assembly as claimed in claim 1, wherein the pull tab comprises a medial section secured on the medial portion of the fastening member and adjacent to the operating portion and a pulling section for being pulled to separate the cable connector assembly and the complementary connector.

3. The cable connector assembly as claimed in claim 2, wherein the medial section of the pull tab defines an engaging recess therein, and wherein the medial portion of the fastening member defines a recess to from a thinner portion adjacent to the operating portion and received in the engaging recess of the pull tab.

4. The cable connector assembly as claimed in claim 2, wherein the pulling section of the pull tab is in parallel to the medial section, and wherein the pull tab comprises a second arm perpendicular to and connecting the pulling section and the medial section.

5. The cable connector assembly as claimed in claim 2, wherein the pull tab comprises a first arm extending vertically from the medial section, the cover defines a slot in the rear end thereof beside the passage, and the first arm of the pull tab is movably received in the slot.

6. The cable connector assembly as claimed in claim 5, wherein the passage of the cover comprises a first channel defined in the first cover-half and a second channel defined in the second cover-half, the slot comprises a first slit defined in the first cover-half and communicating with the first channel and a second slit defined in the second cover-half and communicating with the second channel.

7. The cable connector assembly as claimed in claim 6, wherein the first slit and the second slit each comprise a first edge and a second edge, and wherein the first arm comprises a pair of securing sections extending vertically therefrom and respectively abutting against the first and the second edges of the slot.

8. The cable connector assembly as claimed in claim 6, wherein the first cover-half of the cover defines a first depression communicating with the first channel and the first slit, and the second cover-half defines a second depression communicating with the second channel and the second slit, and wherein the medial section of the pull tab is received in the first and the second depressions.

9. The cable connector assembly as claimed in claim 2, wherein the pulling section of the pull tab defines a semicircular space in a lower section thereof to accommodate the cable therein.

10. The cable connector assembly as claimed in claim 1, wherein the cover defines a second passage recessed from the first passage and having a larger dimension than other portions of the first passage, and wherein the medial portion comprises a stop section movably received in the second passage.

11. The cable connector assembly as claimed in claim 10, further comprising a spring member disposed on the fastening member, and wherein the second passage of the cover defines a first end adjacent to the threaded portion and a second end opposite to the first end, the spring member is disposed between the stop section and the first end.

12. The cable connector assembly as claimed in claim 11, wherein the second passage comprises a first recessed section recessed from the first channel and a second recessed section recessed from the second channel.

13. The cable connector assembly as claimed in claim 1, wherein the first and the second cover-haves are die cast cover-halves, and the first and the second cover-halves define a plurality of cutouts to reduce weight thereof.

14. The cable connector assembly as claimed in claim 1, further comprising a printed circuit board having a front end and a rear end opposite to the front end, and wherein the contacts and the cable are respectively soldered to the front and the rear ends of the printed circuit board to form an electrical connection therebetween.

15. A cable connector assembly, comprising:

a cover comprising a first cover-half, a second cover-half joined together with the first cover-half, a front end, and a rear end opposite to the front end, a first passage extending through the front and the rear ends;

an insulative housing situated at the front end of the cover;

a plurality of contacts retained in the insulative housing;

a cable electrically connected with the contacts;

a fastening member movably and rotatably received in the first passage, the fastening member comprising a medial portion, a threaded portion extending from the medial portion adapted for threadedly engaging with a complementary connector, and an operating portion extending from the medial portion opposite to the threaded portion, the fastening member being movable between a first position with the threaded portion thereof engaging with the complementary connector and a second position with the threaded portion thereof disengaged from the complementary connector; and a pull tab secured to the fastening member, the pull tab defining a first distance with respect to the rear end of the cover in the first position of the fastening member, the pull tab defining a second distance with respect member, the second distance being larger than the first distance.

16. The cable connector assembly as claimed in claim 15, wherein the fastening member comprises a pair of jackscrews.

17. The cable connector assembly as claimed in claim 15, wherein the pull tab comprises a medial section engaged with the fastening member and a first arm in parallel to the medial section, and wherein the rear end of the cover defines a slot therein to receive the first arm of the pull tab.

18. The cable connector assembly as claimed in claim 15, further comprising a spring member disposed on the fastening member, wherein the spring member is in a compressed condition in the first position of the threaded portion of the fastening member, and restores its original shape and moving the fastening member and the pull tab rearwardly in the second position of the threaded portion of the fastening member.

19. The cable connector assembly as claimed in claim 15, wherein the pull tab comprises a medial section engaged with the fastening member and a first arm in parallel to the medial section, and wherein the rear end of the cover defines a slot therein to receive the first arm of the pull tab.

20. A cable connector comprising:

a cover device defining a receiving space;

an insulative housing disposed in a front portion of the receiving space;

a plurality of contacts positioned in the housing;

at least one fastening member enclosed in the cover device beside the housing, said fastening member defining an elongated body movable along a front-to-back direction, a front end of the fastening member defining a locking device for latching to a complementary connector, a rear end of the fastening member defining an operation portion exposed beyond the cover device for unlocking said locking device from the complementary connector;

a cable extending rearward from a rear portion of the cover device and including a plurality of conductors connected to the corresponding contacts, respectively; and a pull tab assembled to the fastening member so as to move along with the fastening member synchronously along said front-to-back direction, said pull tab including a pulling section extending with a distance in a lateral direction perpendicular to said front-to-back direction and angled with said front-to-back direction so as to allow an user to easily grasp the pulling section from an exterior outside of the cover device for conveniently withdrawing the connector rearwardly.

21. The cable connector as claimed in claim 20, wherein said pull tab includes a notch laterally defined therein to receive said fastening member.

* * * * *